United States Patent [19]

Benim

[11] Patent Number: 4,840,695

[45] Date of Patent: Jun. 20, 1989

[54] METHOD FOR UNWINDING ELASTIC TAPE

[75] Inventor: Thomas E. Benim, Kinston, N.C.

[73] Assignee: E. I. Du Pont de Nemours and Company, Wilmington, Del.

[21] Appl. No.: 149,156

[22] Filed: Jan. 27, 1988

[51] Int. Cl.[4] ..... B32B 31/14

[52] U.S. Cl. ..... 156/344; 156/499; 156/584; 219/214

[58] Field of Search ..... 156/344, 499, 584; 219/214; 242/55, 75.1

[56] References Cited

U.S. PATENT DOCUMENTS

| | | | |
|---|---|---|---|
| 2,726,705 | 12/1955 | Marx et al. | 156/499 X |
| 3,243,950 | 4/1966 | Hermes | 57/163 |
| 4,579,290 | 4/1986 | Weber et al. | 242/55 |
| 4,645,135 | 2/1987 | Morris et al. | 242/67.1 R |

*Primary Examiner*—Robert A. Dawson

[57] ABSTRACT

A method for unwinding an elastic strip material from a package that has a propensity to stick to itself. The method includes heating the surface of the package to reduce the sticking propensity of the material. Allows unwinding at controlled elongation.

2 Claims, 3 Drawing Sheets

METHOD FOR UNWINDING ELASTIC TAPE

BACKGROUND OF THE INVENTION

This invention relates to a method of unwinding packages of elastic tape, and more particularly, it polyetherester elements.

Thin elastic strips or films intended for gluing to the legs of baby diapers are known. In the application of such films to diaper stock the film ideally must be capable of being unrolled from a rolled up package without sticking to itself or feeling the effects of film distortion caused by sticking to itself. In the trade the sticking problem is referred to as "blocking". It is often desirable to include an anti-blocking agent such as talc in the elastomer composition to prevent sticking. However, such agents are not completely satisfactory when used with the thin tapes wound on packages for use in diaper leg applications. There still is a problem of the tape sticking to itself particularly from the middle to the end of the package. The force required to unwind tape that is stuck to itself is called "peel resistance" and for purposes of this disclosure is in grams per unit of width of the tape.

SUMMARY OF THE INVENTION

A method of unwinding elastic strip material or tape from a package has been devised to alleviate the problem of such tapes sticking to themselves or feeling the effect of distortion caused by sticking. Freeing the tape from itself is accomplished during unwinding by heating the surface of the package at the location the tape is pulled from the package. The amount of heat applied depends on the composition of. the tape, its thickness, pulling tension applied, etc., but generally temperatures in the range from about 25° C. to about 50° C. are satisfactory.

The amount of force needed to pull the tape from the roll, or peel resistance, is from about 5 to 25 grams/mm, when measured at room temperatre (20° C.). This peel resistance is reduced about 50–75% by heating and allows unwinding at a controlled and low stretch elongation which prevent breaking of the tape.

The location on the package surface from which the tape is pulled by a puller roll is important and preferably the location is within an included angle whose apex is at the point of tangency on the roll of a plane perpendicular to the package surface. This angle is preferably from about 20° above the plane to about 30° below the plane.

DETAILED DESCRIPTION OF THE PREFERRED EMBODIMENT

Figure 1:
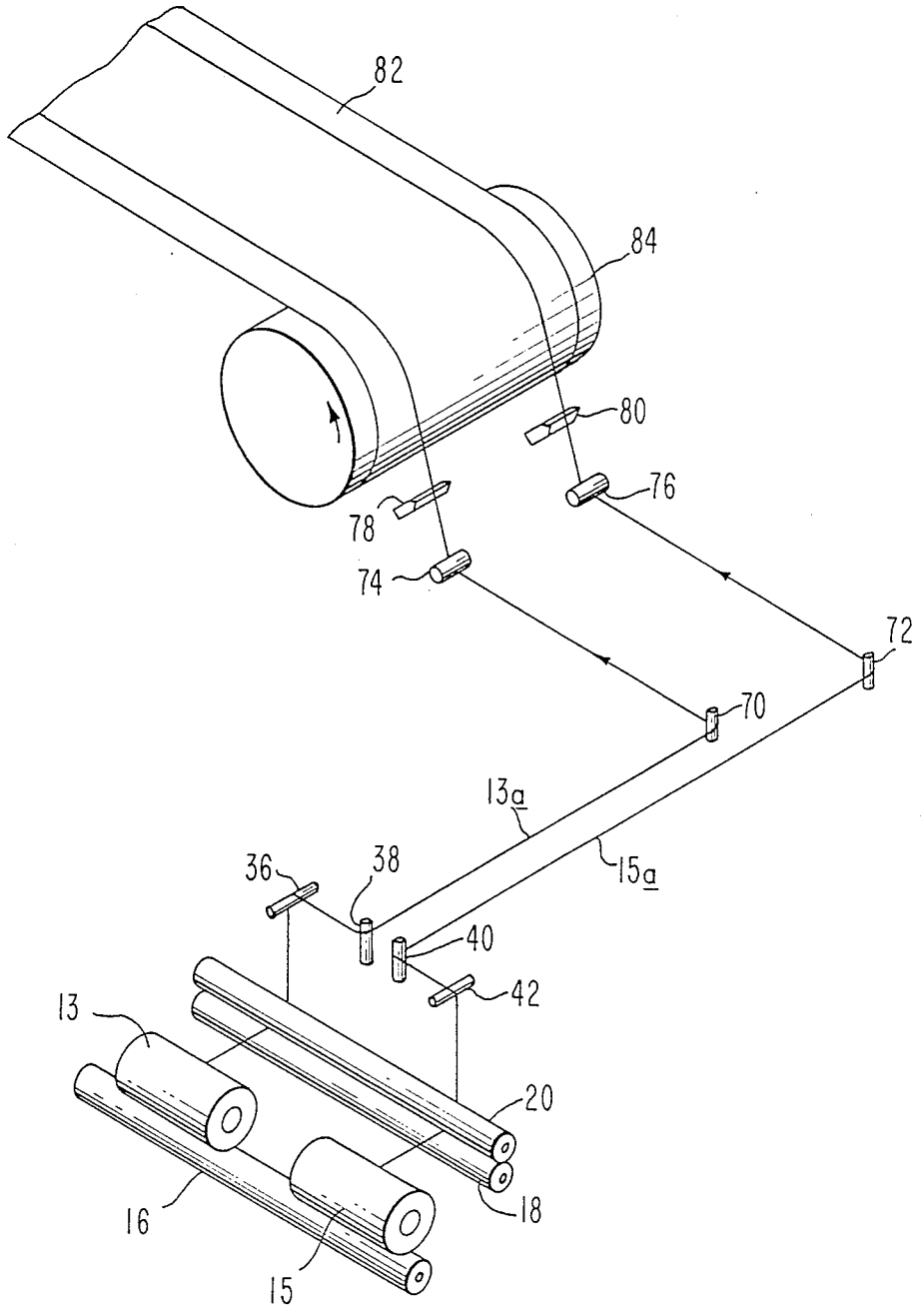
FIG. 1 is a perspective view of apparatus used in practicing the invention.

Referring to FIG. 1, the apparatus chosen for purposes of illustration of this method generally includes as components thereof an unwinding unit 11 from which tapes 13*a*, 15*a* are advanced around turning guides 70, 72 under alignment rollers 74, 76 and past applicators 78, 80 which apply glue to tapes 13*a*, 15*a* respectively. The tapes are then applied to a sheet of diaper stock 82 being delivered around roll 84.

Figure 2:
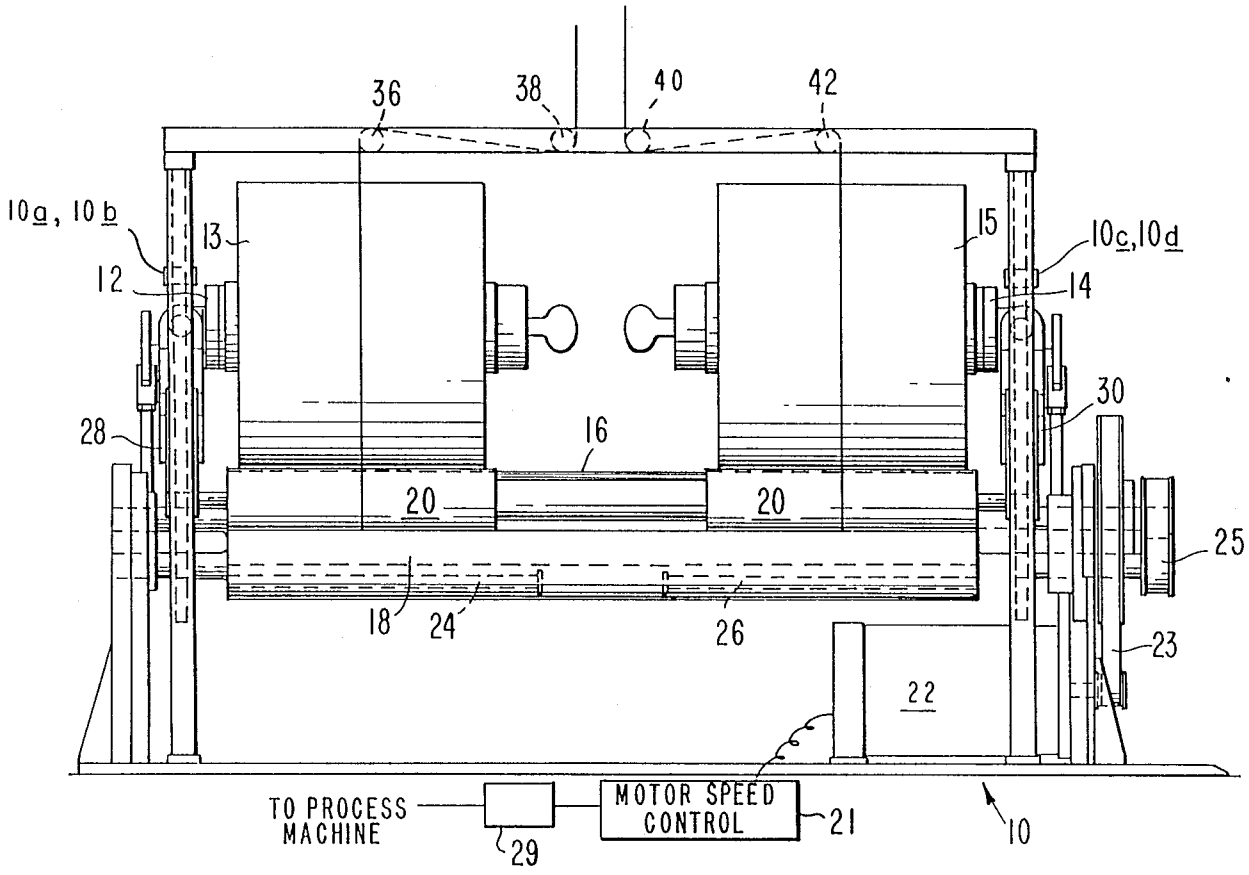
FIG. 2 is a top view of the unwinder of FIG. 1.
Figure 3:
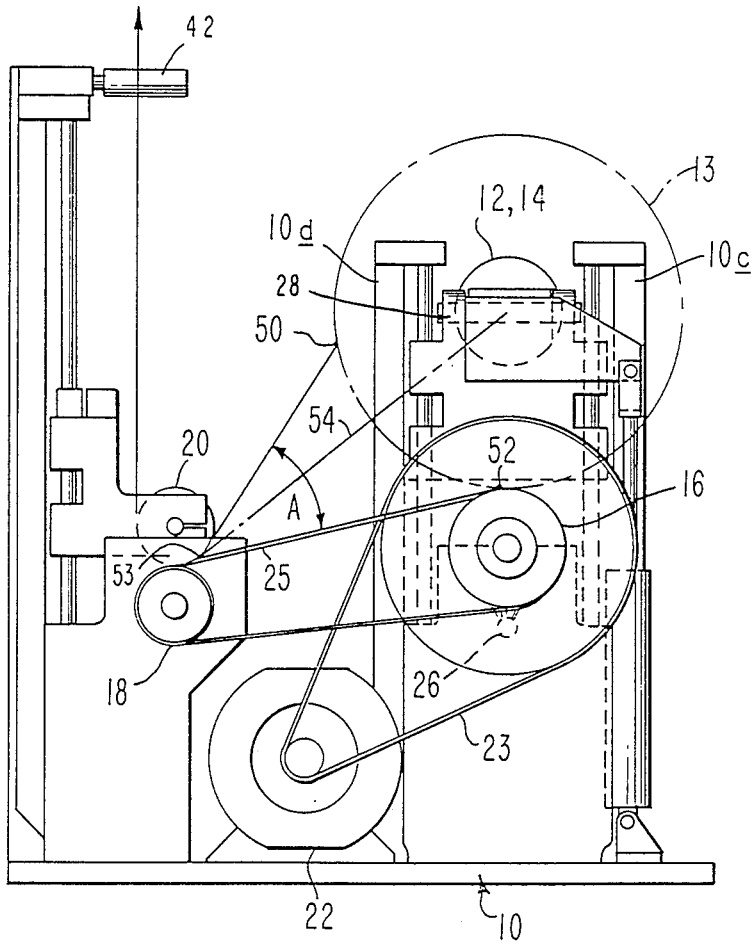
FIG. 3 is side elevation view of the unwinder of FIG. 2.

As shown in FIGS. 2 and 3, the unwinding unit 11 includes a frame 10, rotatable chucks 12, 14 carrying packages 13, 15, respectively, mounted to the frame for linear movement toward and away from surface driven engagement with a drive roll 16 rotatably mounted to the frame, a puller roll 18 with its associated pinch roll 20, an electric motor 22 mounted to the frame and radiant heaters 24, 26 mounted to frame 10 below drive roll 16.

Chucks 12, 14 are rotatably and pivotally mounted to slides 28, 30, respectively. Slides 28 and 30 are free to move vertically in guides 10*a*, 10*b*, 10*c* and 10*d* of frame 10 for linear movement toward and away from the surface of drive roll 16.

Drive roll 16 and puller roll 18 are driven by motor 22 via belts 23 and 25, respectively, in such a manner that the speed of the surface of roll 18 is about 6 to 15% faster than the surface of roll 16. The speed of motor 22 is controlled by motor speed control 21. Nip roll 20 rests on the surface of puller roll 18 and is rotatably journaled in frame 10. Tape guides 36, 38, 40 and 42 are rotatably mounted to the frame 10 to direct the tapes for further processing after being unwound from packages 13, 15.

The location that the tape is pulled from the surface of the package is also an important feature of the invention. More particularly, that location may be between points 50, 52 on the surface of package 13 which are encompassed by the angle A whose apex 53 is at the point of tangency on roll 20 of a plane 54 that is perpendicular to the surface of package 13. The angle A of about 50° includes plane 54 and is from about 20° above the plane at point 50 to about 30° below the plane at point 52.

In operation, the tape from each package 13, 15 is fed between puller roll 18 and nip roll 20 up to guides 36, 38, 40 and 42 as shown as the tape is consumed in further processing the motor 22 drives rolls 16 and 18 to unwind the tape or strip material from the packages 13, 15 simultaneously. Heaters 24, 26 heat the surface of roll 16 to a temperature in the range of 25 to 50° C. The heated roll 16 in turn softens the surfaces of the packages to release the top layer of strip material from sticking to the underlying layer on the package at the lcoation where the strip material is pulled from the package.

Definitions

Peel Resistance

Peel resistance is the force in grams/unit width of the strip needed to pull the strip from the package and is measured using a hand held force gauge and pulling the strip of the package keeping the angle of pull perpendicular to the surface of the package.

Stretch Elongation

Stretch elongation (E) is defined as the percent increase in surface speed from the surface of the package to the surface of the puller roll.

$$\% E = \frac{\text{velocity roll}}{\text{velocity package}} - 1 \times 100$$

I claim:

1. A method of unwinding from the surface of a package an elastic strip material wound on the package, said strip having a peel resistance of from about 5 to about 25 grams/mm, said method comprising: rotating the package at a substantially constant peripheral rate of speed; pulling said strip material from said package at a location on said surface; and heating the surface of said package from a temperature of about 25° to about 50° C. to reduce the peel resistance by about 50 to 75%.

2. A method of unwinding from the surface of a package an elastic strip material wound on the package, said strip having a peel resistance of from about 5 to about 25 grams/mm, said method comprising: rotating the package at a substantially constant peripheral rate of speed; pulling said strip material from said package by means of a driven roll and an associated nip roll from a location on said surface of the package at a stretch elongation of from about 2% to about 25%, said location being within an included angle whose apex is at the point of tangency on the nip roll of a plane perpendicular to the package surface and includes said plane, said angle being from about 20° above the plane to about 30° below the plane; and heating the surface of said package to a temperature of from about 25° to about 50° C. to reduce the peel resistance by about 50 to about 75%.

* * * * *